US009347619B2

(12) United States Patent
Schupple et al.

(10) Patent No.: US 9,347,619 B2
(45) Date of Patent: May 24, 2016

(54) LIGHT EMITTING DIODE RETROFIT KIT FOR HIGH INTENSITY DISCHARGE LIGHTING

(71) Applicant: LED Industries, Inc., Gurnee, IL (US)

(72) Inventors: James Willis Schupple, St. George, UT (US); Joseph Brian Henrie, Genoa City, WI (US)

(73) Assignee: LED Industries, Inc., Spring Grove, IL (US)

( * ) Notice: Subject to any disclaimer, the term of this patent is extended or adjusted under 35 U.S.C. 154(b) by 259 days.

(21) Appl. No.: 14/138,748

(22) Filed: Dec. 23, 2013

(65) Prior Publication Data

US 2014/0111990 A1 Apr. 24, 2014

Related U.S. Application Data

(63) Continuation-in-part of application No. 13/328,754, filed on Dec. 16, 2011, now Pat. No. 8,807,783.

(60) Provisional application No. 61/424,154, filed on Dec. 17, 2010.

(51) Int. Cl.

| | |
|---|---|
| ***F21K 99/00*** | (2010.01) |
| ***F21V 19/00*** | (2006.01) |
| ***F21V 31/00*** | (2006.01) |
| ***F21V 29/80*** | (2015.01) |
| ***F21V 29/81*** | (2015.01) |
| *F21Y 101/02* | (2006.01) |
| *F21V 29/77* | (2015.01) |

(52) U.S. Cl.

CPC ... *F21K 9/30* (2013.01); *F21K 9/10* (2013.01); *F21V 19/0055* (2013.01); *F21V 29/80* (2015.01); *F21V 29/81* (2015.01); *F21V 31/005* (2013.01); *F21V 29/77* (2015.01); *F21Y 2101/02* (2013.01); *Y10S 362/80* (2013.01); *Y10T 29/49117* (2015.01); *Y10T 29/49716* (2015.01)

(58) Field of Classification Search

CPC ..... F21K 9/30; F21K 9/10; F21V 29/81; F21V 29/80; F21V 19/0055; F21V 31/005

See application file for complete search history.

(56) References Cited

U.S. PATENT DOCUMENTS

| | | | | |
|---|---|---|---|---|
| 7,972,035 | B2 | 7/2011 | Boyer | |
| 8,251,552 | B2 | 8/2012 | Rooms et al. | |
| 8,506,127 | B2 | 8/2013 | Russello et al. | |
| 9,101,027 | B2 * | 8/2015 | Donegan | F21V 29/77 |

OTHER PUBLICATIONS

U.S. Appl. No. 60/982,240, filed Oct. 24, 2007, Inventor: Boyer, with Official Filing Receipt, 28 pgs.

* cited by examiner

*Primary Examiner* — David V Bruce

(74) *Attorney, Agent, or Firm* — Banner & Witcoff, Ltd.

(57) ABSTRACT

A housing once included a high intensity discharge (HID) light source, lens, and fixture chamber between the housing and lens. The housing is retrofit to exclude a routinely functioning HID light source and exclude at least a portion of the HID lens. The housing is made to include at least a first support for at least one light emitting diode (LED) light source and an LED diode lighting fixture chamber. A second support is affixed at least to the first support and is positioned at least in part outside the LED fixture chamber. The LED light source is mounted to the second support outside the LED fixture chamber. At least one LED light source lens is mounted to provide a lens for the LED light source, also outside the LED lighting fixture chamber. The LED light source is thereby substantially free of exposure to the temperature effects.

6 Claims, 10 Drawing Sheets

LIGHT EMITTING DIODE RETROFIT KIT FOR HIGH INTENSITY DISCHARGE LIGHTING

CROSS-REFERENCE TO RELATED APPLICATIONS

This application claims the benefit of patent application Ser. No. 13/328,754 filed Dec. 16, 2011, pending, which claims the benefit of provisional patent application No. 61/424,154 filed on Dec. 17, 2010.

BACKGROUND OF THE APPLICATION

This invention relates to lighting, including high intensity discharge lighting and light emitting diode lighting.

The HID (High Intensity Discharge) exterior lighting industry has suffered from energy inefficiencies and light degradation over the useful life of an HID luminaire. The result has been high maintenance costs and energy waste. The Light Emitting Diode (LED) stands as one of the possible answers if engineered correctly.

The LED has two weaknesses: 1—heat (the $T_J$ junction has a temperature determined by the manufacturer of the LED product, that should not be exceeded or the life hours of the LED product will diminish) and, 2—excessive drive current (the higher the drive current the shorter the life of the LED product, the lower the drive current the longer the life of the LED product).

SUMMARY OF THE INVENTION

An LED retrofit kit according to embodiments of this invention is for HID lighting, especially HID exterior lighting. The LED retrofit kit allows the owner of HID lighting fixtures to keep the HID light fixture existing housing, remove the nucleus of the existing fixture such as the HID Luminaire and replace it with an LED retrofit kit.

Embodiments of the invention have both the thermal management and the drive current engineered to produce an LED product that will last for 80,000+ life hours while producing needed amounts of light (lumens) to replace an HID fixture.

Embodiments of the invention includes LED modules, which may include heatsinks, LEDs which may be mounted and anodized to the heatsinks, optic lenses, gaskets, and an insert tray for the existing fixture housing, In a principal aspect, the invention comprises a housing that before being retrofit included a high intensity discharge light source, a high intensity discharge lens, and a high intensity discharge lighting fixture chamber defined between the housing and the high intensity discharge lens. The housing is retrofit to exclude a routinely functioning high intensity discharge light source and exclude at least a portion of the high intensity discharge lens.

The housing is made to include at least a first support for at least one light emitting diode light source in place of the portion of the high intensity discharge lens. The housing thereby has a light emitting diode lighting fixture chamber between the first support, any remaining portion of the high intensity discharge lens, and the housing. A second support for the light emitting diode light source is affixed at least to the first support and is positioned at least in part outside the light emitting diode lighting fixture chamber. The light emitting diode light source is mounted to the second support outside the light emitting diode lighting fixture chamber. Wiring connects the light emitting diode light source to power.

At least one light emitting diode light source lens is mounted to provide a lens for the light emitting diode light source, also outside the light emitting diode lighting fixture chamber. With this aspect, the retrofit high intensity discharge lighting fixture is no longer a source of high intensity discharge light and is instead a source of light emitting diode light. Also, the light emitting diode light source is outside the light emitting diode lighting fixture chamber, and is thereby substantially free of exposure to the temperature effects of being within either the high intensity discharge lighting fixture chamber or the light emitting diode lighting fixture chamber.

Additional embodiments of invention include a method of retrofitting a high intensity discharge lighting fixture, the fixture before being retrofit including a housing, a high intensity discharge light source and a high intensity discharge lens, and a high intensity discharge lighting fixture chamber defined between the housing and the high intensity discharge lens. The method comprises, in any order and not necessarily the stated order, a disabling step, a removing step, a placing step, an affixing step, a wiring step, and a mounting step.

Disabling involves disabling if not removing from the fixture the high intensity discharge light source. Removing involves at least partially removing at least a part of the high intensity discharge lens from the fixture, if not fully removing the lens from the fixture. Placing involves placing a first support for at least one hereinafter-identified light emitting diode light source in place of the at least a portion of the high intensity discharge lens, thereby providing a light emitting diode lighting fixture chamber between the first support, any remaining portion of the high intensity discharge lens, and the housing. Affixing involves affixing a second support for at least one light emitting diode light sources to the first support and positioning at least a part of the second support outside the light emitting diode lighting fixture chamber. Mounting involves mounting the above-referenced at least one light emitting diode light source to the second support outside the light emitting diode lighting fixture chamber. Wiring involves wiring the at least one light emitting diode light source to power. Placing also involves placing at least one light emitting diode light source lens to provide a lens for the at least one light emitting diode light source, also outside the light emitting diode lighting fixture chamber.

With the method accomplished, the retrofit high intensity discharge lighting fixture is no longer a source of high intensity discharge light and is instead a source of light emitting diode light, and also the at least one light emitting diode light source, being outside the light emitting diode lighting fixture chamber, is substantially free of exposure to the temperature effects of being within either the high intensity discharge lighting fixture chamber of the light emitting diode lighting fixture chamber.

BRIEF DESCRIPTION OF THE DRAWING

The accompanying drawing includes figures as follows.

DETAILED DESCRIPTION OF THE PREFERRED EMBODIMENTS

Figure 1:
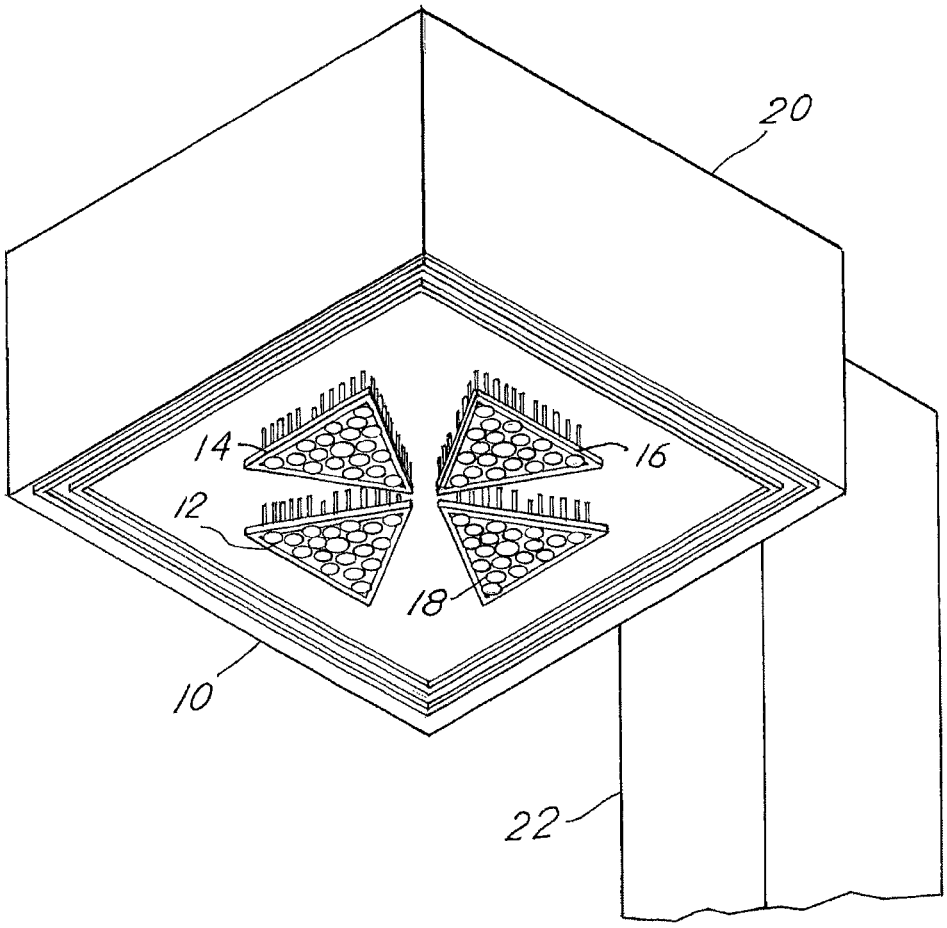
FIG. 1 is a perspective view of a retrofit kit in original light fixture elements as it might appear on a post.

Referring to FIG. 1, the invented retrofit kit 10 may appear in public in part in the form of multiple modules, as for example with four modules 12, 14, 16, 18, visible below an original housing 20 atop a light pole or post 22.

Figure 2:
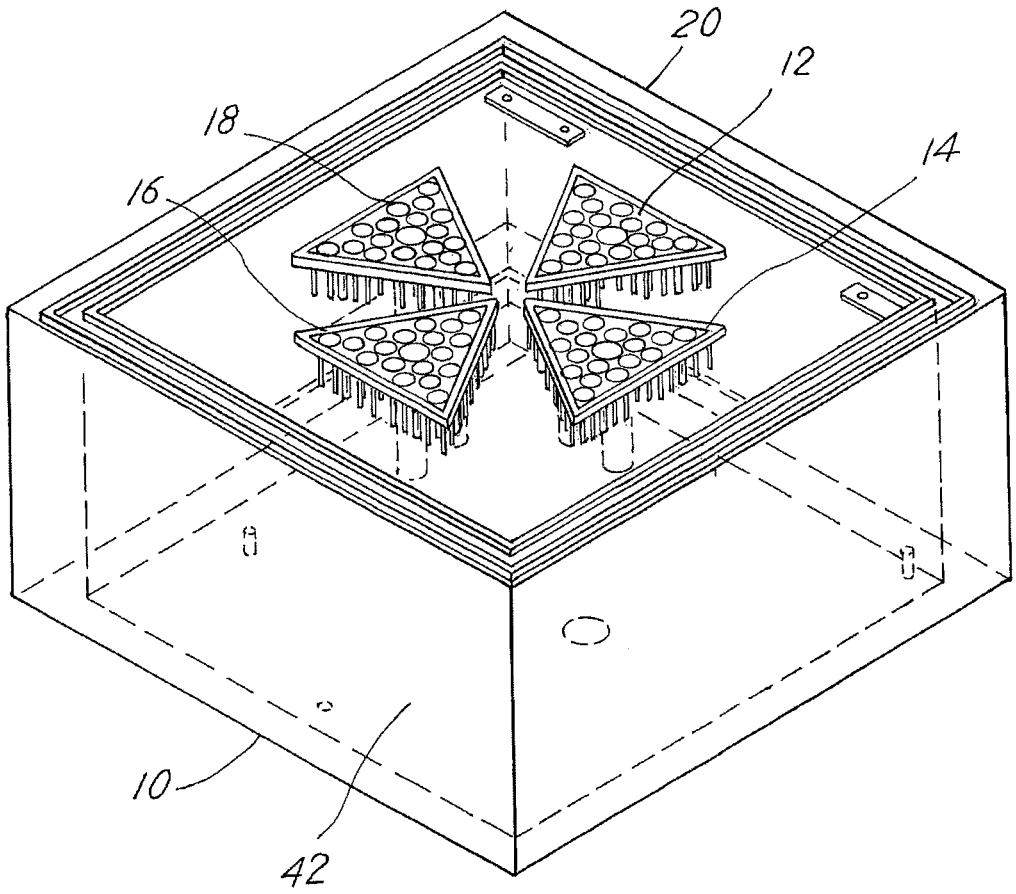
FIG. 2 is an assembled perspective view of a retrofit kit and original light fixture elements according to the invention.
Figure 3:
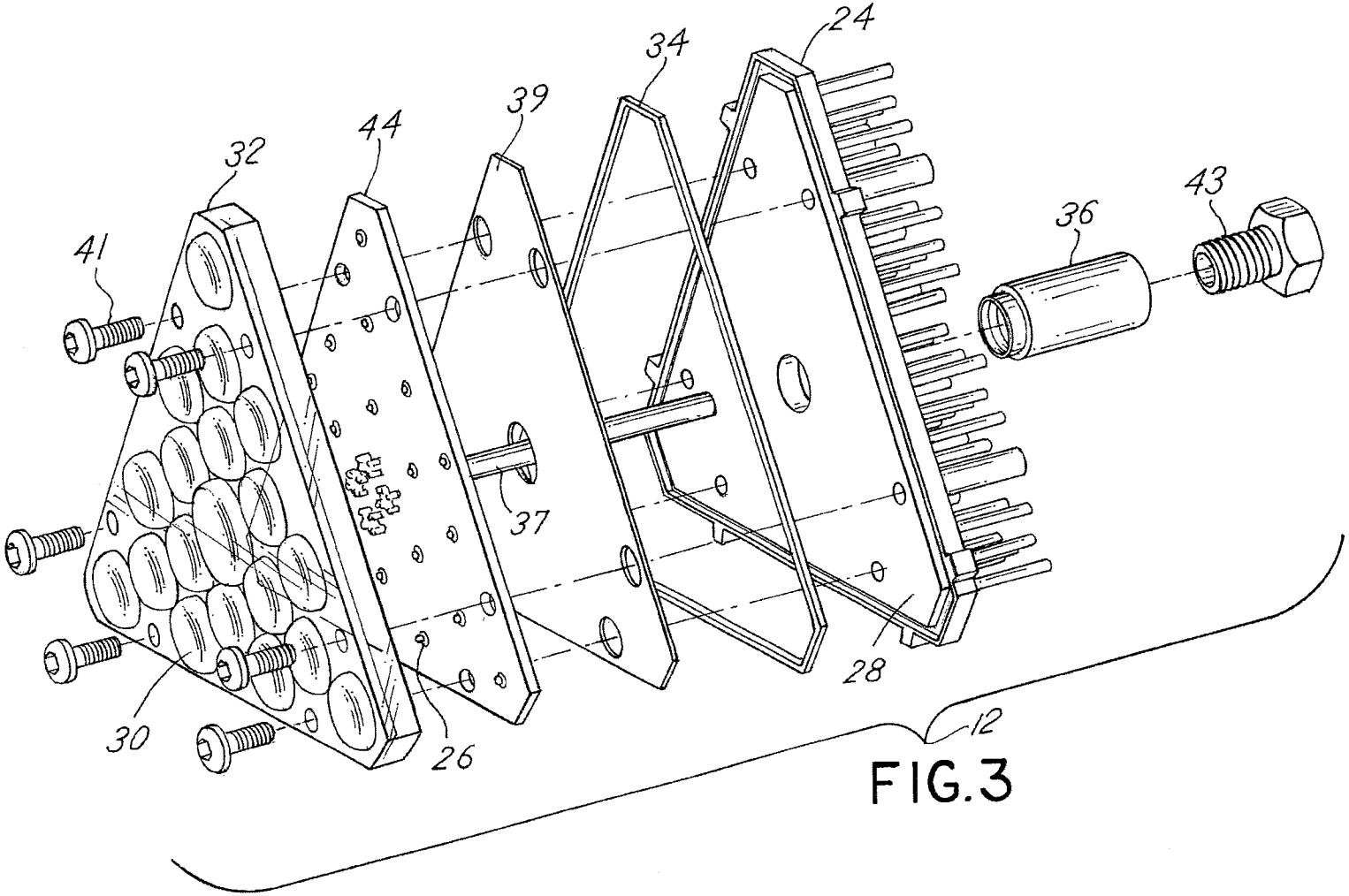
FIG. 3 is an exploded perspective view of a module according to the invention.

Referring to FIG. 2, the kit 10 is shown on a workbench. The modules 12, 14, 16, 18 of the invented retrofit kit can be constructed in different shapes and sizes. An example as in the accompanying FIGS. 2 and 4 would be the following: a 4 inch isosceles triangle marked as an anodized heat sink 24 with fifteen LEDs such as LED 26 and a microprocessor (not shown). Beginning with a heat sink 24 of that size and shape, the light emitting diodes such as diode 26 are mounted and anodized to the flat surface 28 of the heat sink 24 for maximum heat dissipation. Other electronics such as the microprocessor are also mounted to the flat surface 28 of the heat sink allowing for greater control of the completed module 12.

Figure 7:
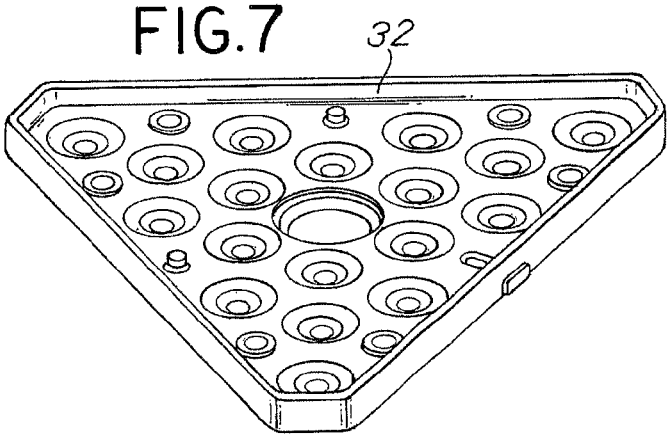
FIG. 7 is a second perspective view of the lens plate, from its opposite side as compared to FIG. 6.

Each LED 26 of the module 12 is on an LED plate 44 and covered with an optic lens such as lens 30, see also FIG. 7, directing and focusing the light from each LED to a desired area and pattern. The lenses for the LEDs are formed in common within a lens plate 32. A thermal pad 39 is opposite the lens plate 32, between the LED plate 44 and the heat sink 24.

The module 12 is sealed with a lens gasket 34 and the lens plate 32 from above—in workbench orientation—to keep out moisture and dust. Screws 41 fasten the lens plate 32, LED plate 44 and pad 39 to the heat sink 24. As in FIGS. 1-2, module 12 is mounted to the exterior of the existing fixture housing 20 to allow for proper air flow and thermal management. The module 12 is mounted to the exterior in that it is mounted above—in workbench position—an insert tray that will be described. Screw 43 accomplishes the mounting.

One or more metal tubes also called offset conduits 36 are connected to the back of the heat sink 24 of the module 12. They are screwed on, or alternatively they are forged integrally with the heat sink 24. The tubes or offset conduits 36 contain the wires 37 to and from the LEDs and the other electronics (not shown) of the module 12. These tubes 36 along with screw 43 also serve to mount each module 12 to a metal plate 38 that is also called an insert tray, see FIG. 2. The plate or tray 38 becomes a part of the retrofit kit on the existing fixture. The plate or tray 38 and a gasket 40, see FIG. 4, seal the original housing of the existing fixture from air, dust and moisture.

The number of modules used in any application is determined by the existing HID light being replaced. The brighter the existing unit the more modules needed. As in the figures, four modules may be used, for example.

Figure 4:
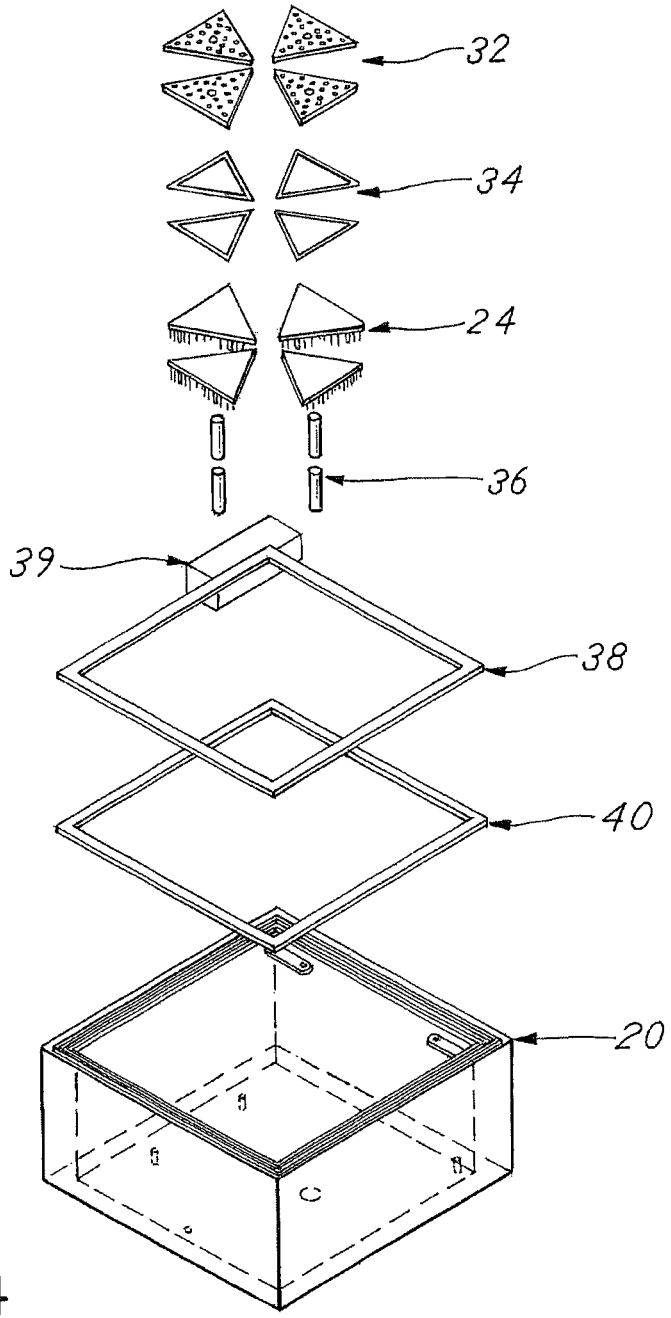
FIG. 4 is an exploded perspective view of a retrofit kit and original light fixture elements according to the invention.

The metal plate or insert tray 38 replaces the glass lens of the existing fixture. Power supply components, including a driver 39, see FIG. 4, are mounted inside the existing fixture housing 20. The seals of the original fixture are maintained or replaced by the identified gasket 40 below the insert tray 38 to assure a proper seal for IP 65 and IP 66 ratings.

Other optional electronics (not shown) may be added, and they may allow the LEDs in the retrofit kit to be dimmed in powering-on or powering-off, or to save additional power. The optional electronics may be managed by motion detectors (not shown), photo cells (not shown), or may be preprogrammed. These additional, optional components can be added into the fixture housing and sealed, with the driver, or added to the LED module, depending on available area.

The invention allows the retrofit kit to meet or exceed the qualifications set by states and the federal governments in relation to Solid Sate Lighting (SSL) as well as testing agencies such as UL, IES, and Energy Star.

As in the Summary above, a preferred embodiment thus comprises a housing 20 that before being retrofit included a high intensity discharge light source (not shown), a high intensity discharge lens (not shown), and a high intensity discharge lighting fixture chamber defined between the housing 20 and the high intensity discharge lens (not shown). Once retrofit, the housing 20 excludes a routinely functioning high intensity discharge light source and excludes the high intensity discharge lens.

The housing 20 includes at least a first support such as the plate 38 for a plurality of light emitting diode light sources such as the modules (e.g., 12). The first support is in place of the high intensity discharge lens. The housing 20 thereby has a light emitting diode lighting fixture chamber 42 (FIG. 2) between the first support such as the plate 38 and the housing 20. At least one element of a light emitting diode light such as the driver 39 is located within the light emitting diode lighting fixture chamber 42. A seal of the light emitting diode lighting fixture chamber, such as the gasket 40, is between the first support and the housing.

A second support for the light emitting diode light sources such as the tube or conduit 36 is affixed at least to the first support such as the plate 38 and positioned at least in part outside the light emitting diode lighting fixture chamber 42. The second support includes a wiring channel and wiring 37 passing through the wiring channel, and further includes a heat sink such as the heat sink 24.

A third support such as the plate 44 for the LEDs 26 is outside the light emitting diode lighting fixture chamber. The third support such as plate 44, is mounted to the second support, such as conduit 36, and the light emitting diode light sources, e.g., are mounted to the third support. The above-referenced plurality of light emitting diode light sources are also included, mounted as above-described so as to be outside the light emitting diode lighting fixture chamber.

A plurality of light emitting light source lenses such as lens 30 are mounted and sealed to the third support such as plate 44. The light emitting diode light sources 26 are sealed between the light emitting diode light source lenses such as 30 and the third support such as plate 44. The number of light emitting light source lenses is such as to provide a lens for each of the plurality of light emitting diode light sources.

Figure 5:
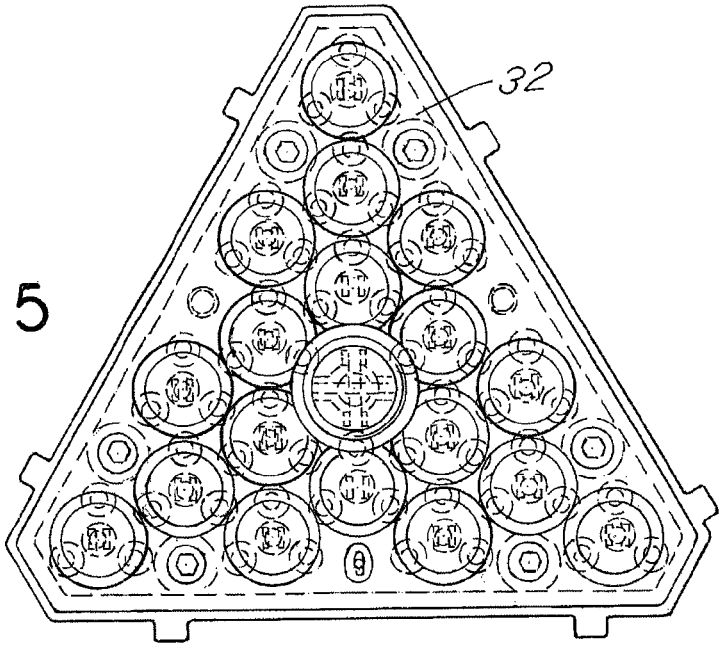
FIG. 5 is a plan view of the lens plate of the preferred embodiment.
Figure 6:
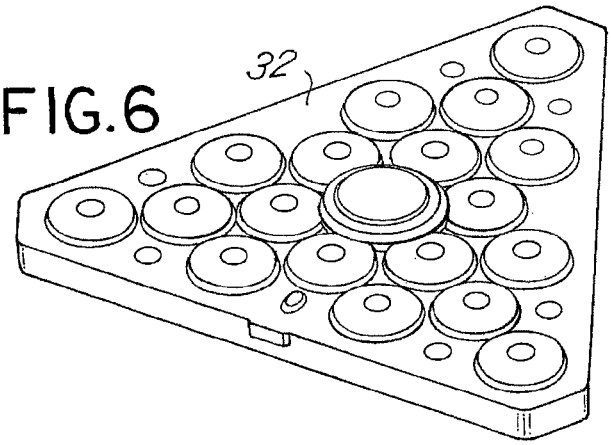
FIG. 6 is a perspective view of the lens plate.

As in FIGS. 5-7, another preferred grouping of LEDs and lenses includes eighteen of each. Viewed from outside, as in FIGS. 5-6, the lenses are concave, domed outward, to spread light. From inside, as in FIG. 7, the lenses are convex.

The pattern of LEDs and lenses, along with the shapes of the plates in a module, tightly and efficiently pack the LEDs lenses, and locations for screws, across plate surfaces. Each side of a plate has four LEDs and lenses. Inside the extent of this outer grouping, each side of a plate has three LEDs and lenses. Inside the extent of this middle grouping, three LEDSs and lenses surround the lens center in a triangle. That is, inside the middle grouping, each side has two LEDs and lenses, both of which also count as two LEDs and lenses on other sides.

To prevent spillover outside areas to be illuminated, the outer portions of the lenses may limit the dispersion of light.

Wiring 37 connects the light emitting diode light sources to power and connects the light emitting diode light sources to the at least one element of a light emitting diode light that is located within the light emitting diode lighting fixture chamber.

When installed, the retrofit high intensity discharge lighting fixture is no longer a source of high intensity discharge light and is instead a source of light emitting diode light. Also, the light emitting diode light sources, being outside the light emitting diode lighting fixture chamber, are substantially free of exposure to the temperature effects of being within either the high intensity discharge lighting fixture chamber of the light emitting diode lighting fixture chamber.

Figure 8:
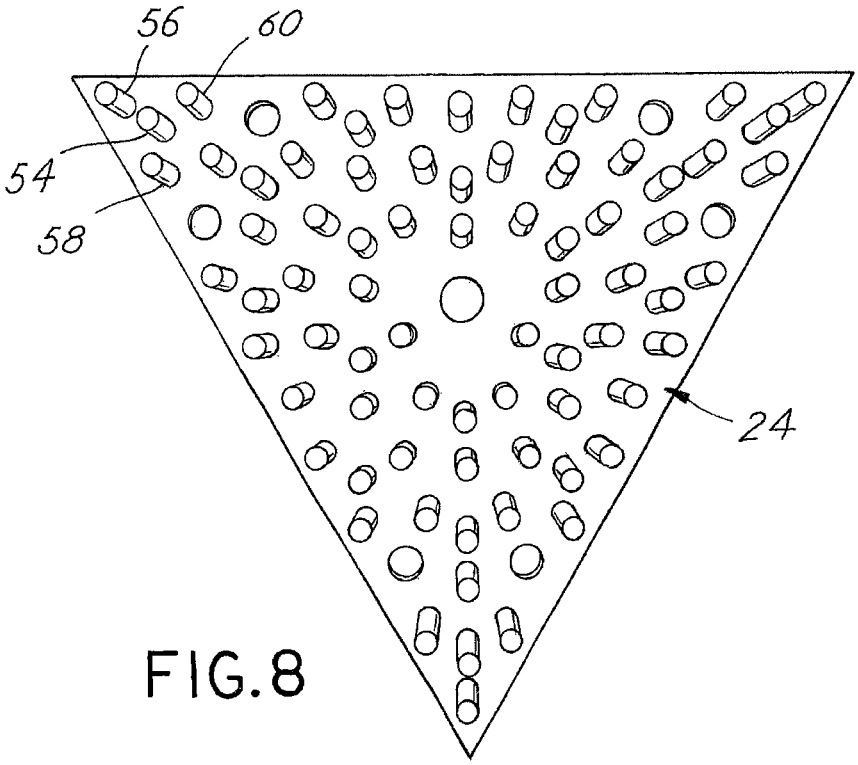
FIG. 8 is a fish eye view of an alternate embodiment of the heat sink, showing its cooling pins.
Figure 9:
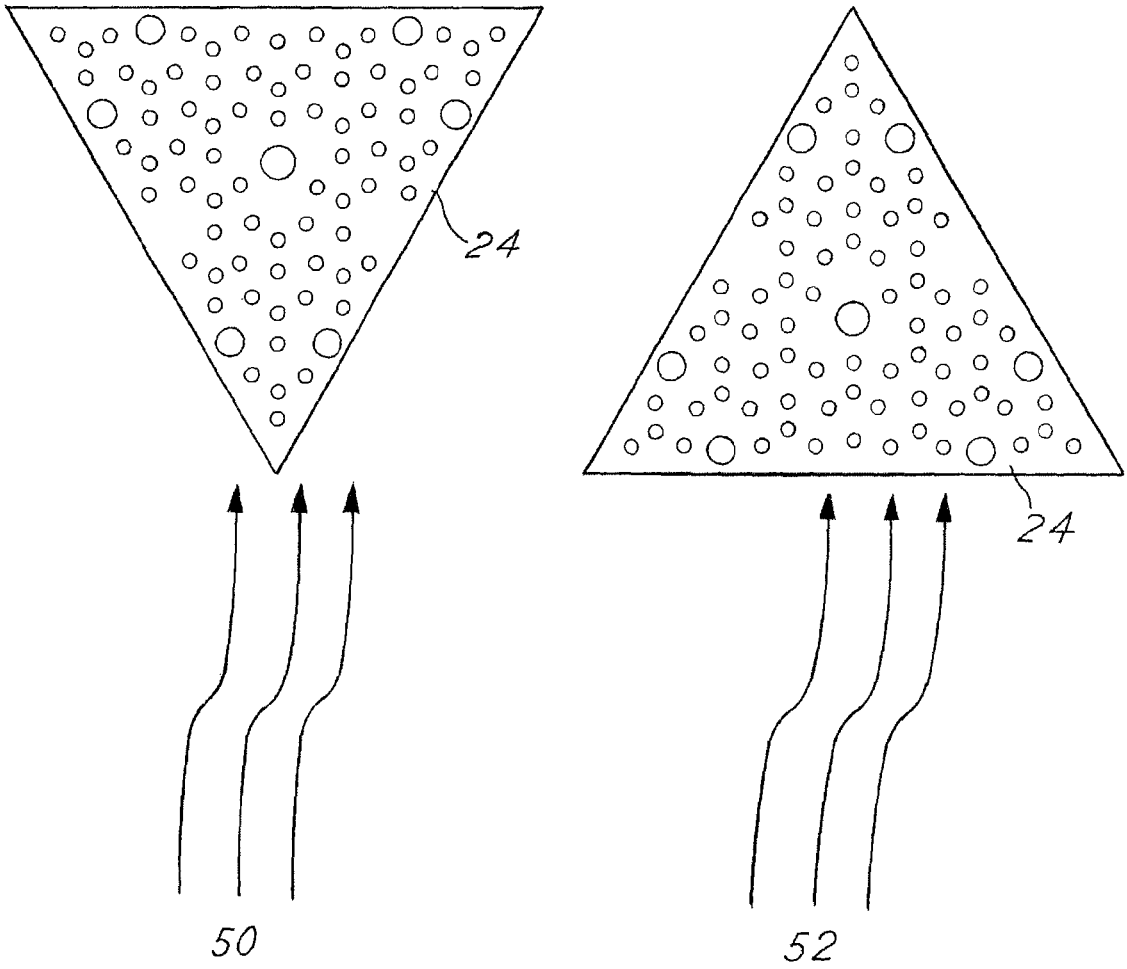
FIG. 9 includes additional images similar to FIG. 8.

Most preferably, the third support is in the form of the plate 44. The second support includes the elongated post 36 from the first support to the third support. The elongated post includes the wiring channel. Both the third support and the elongated post are part of a design to draw maximum heat (dissipation) away from the LEDS and precisely the $T_J$ Junction. Strands of metal on the back of the heat sink plate 46, FIGS. 8-9, in the form of round pins such as pin 54, enhance the thermal cooling properties of the design. The round pins allow circulation of air from substantially any direction as shown in FIG. 5. Air flow in the directions of air flow lines 50 and 52, as examples, are effective for heat transfer. The position and angle of the heat sink 24 is substantially not relevant to cooling as air flow is substantially uninhibited in substantially all directions.

As highly preferred, there are seventy-two pins such as pin 54 on each preferred trapezoidal 4 inch heat sink; the approximate length of each pin is one inch and the approximate diameter of each pin is 0.102 inches. The pins are placed in groups of four as in the group of four pins 54, 56, 58, 60. The center pin 54 of the group is the primary pin; primary to thermal transfer. The remaining or outer pins 56, 58, 60 are secondary pins, secondary to thermal transfer. An LED chip is placed precisely over the center pin to allow the pins to provide the maximum benefit. Other pins, and posts are threaded and are used for mounting the lens onto the heat sink with screws, and mounting the heat sink to the backing plate of the retrofit kit.

The process of manufacture used for the heat sinks 24 includes cold forging. In this process, aluminum is placed in a high tonnage ton press. The press forces the aluminum into a mold by pressure not heat. The efficiencies gained are significant. Internal testing shows a gain of 3 to 5 degrees C. with cold forged heat sinks over the less preferred alternative of die cast heat sinks.

Light-emitting-diode-light-source temperature monitors, and light-emitting-diode-light-source controls, as above (again, not shown), are also present. The controls respond to the monitors to control at least one of the intensity of the light of the light emitting diode light sources, the temperature of the light emitting diode light sources and the power to the light emitting diode light sources.

Figure 10:
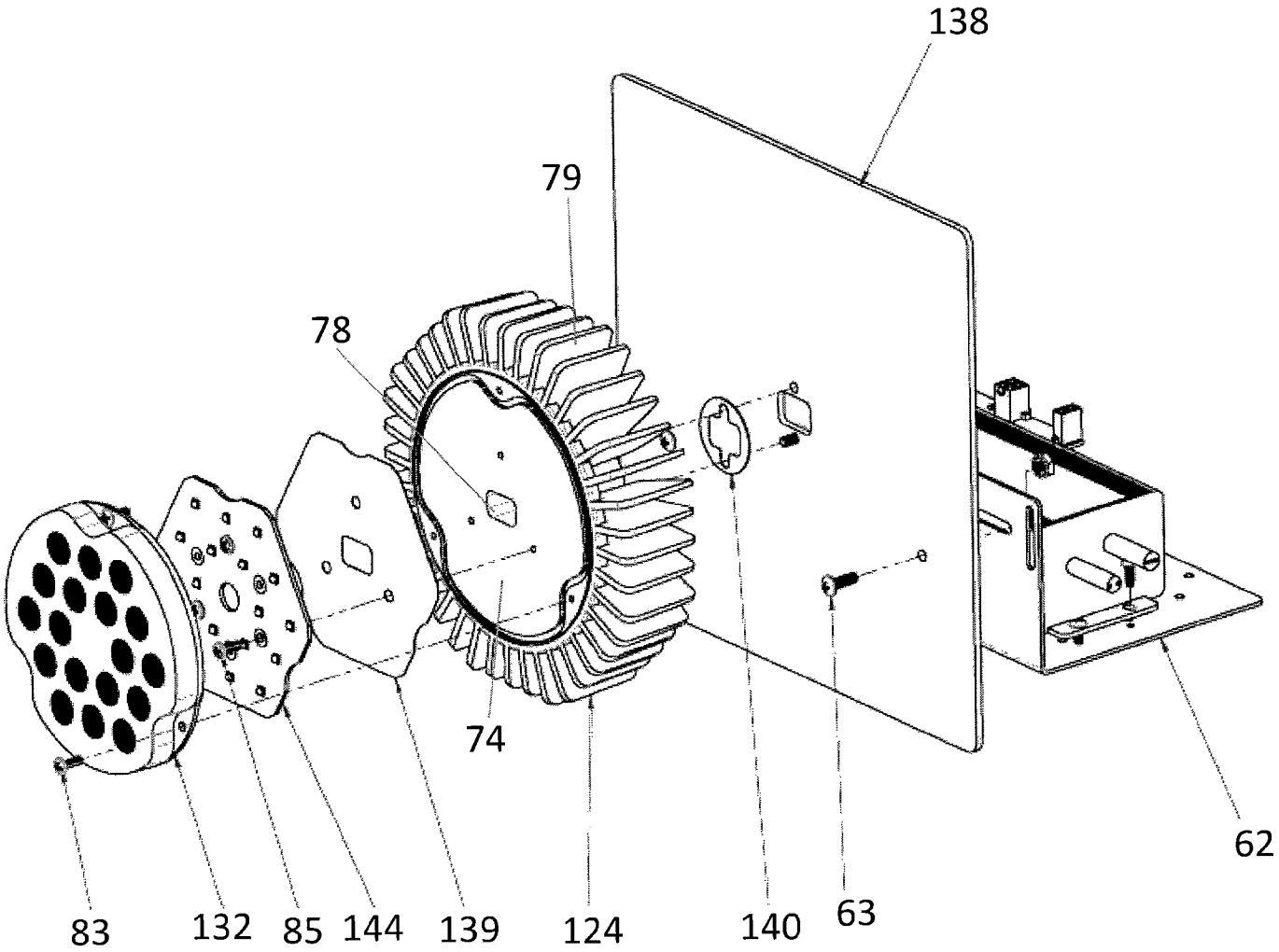
FIG. 10 is an exploded perspective view of a second embodiment of the invention.
Figure 11:
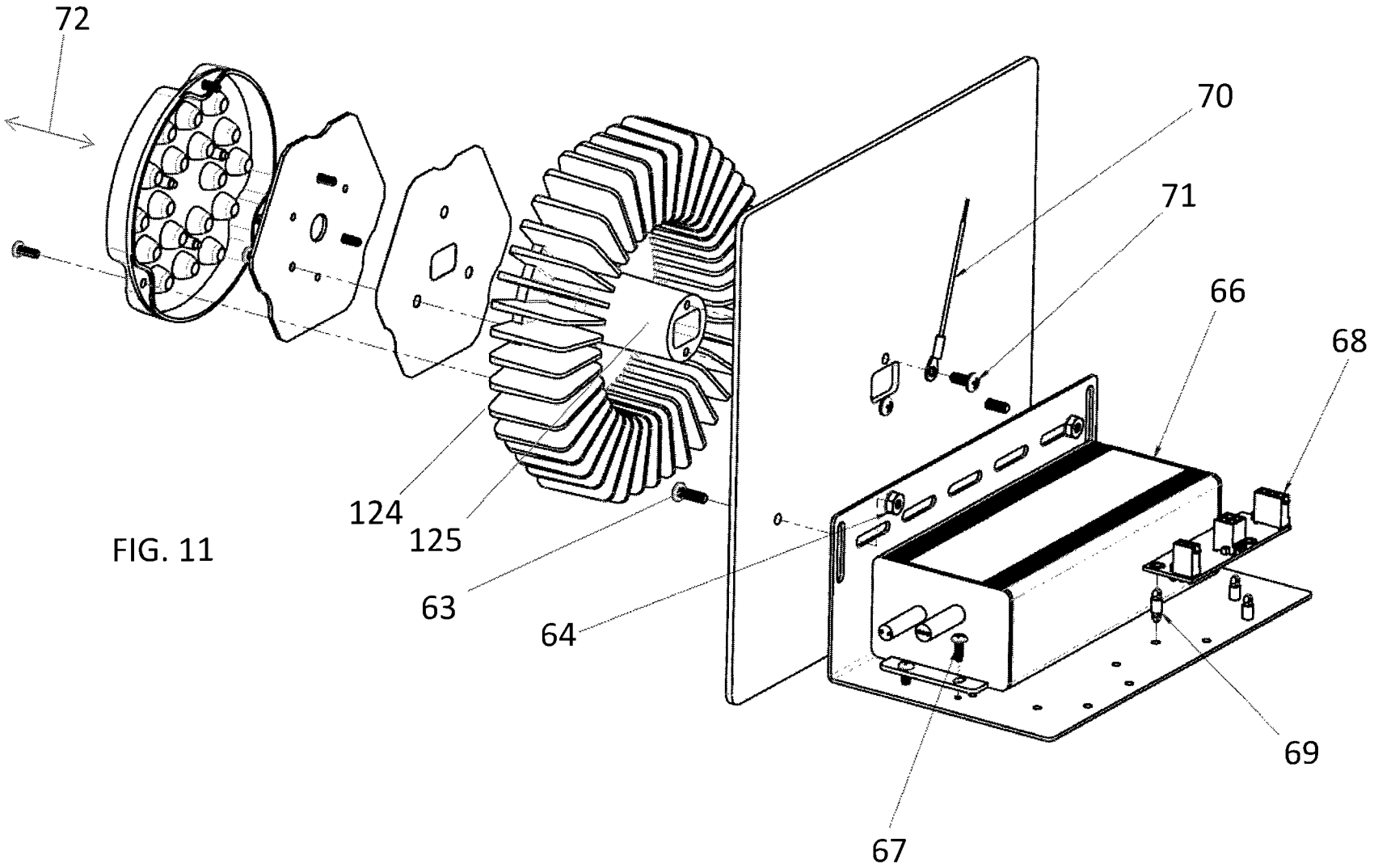
FIG. 11 is a second exploded perspective view of a second embodiment of the invention.
Figure 12:
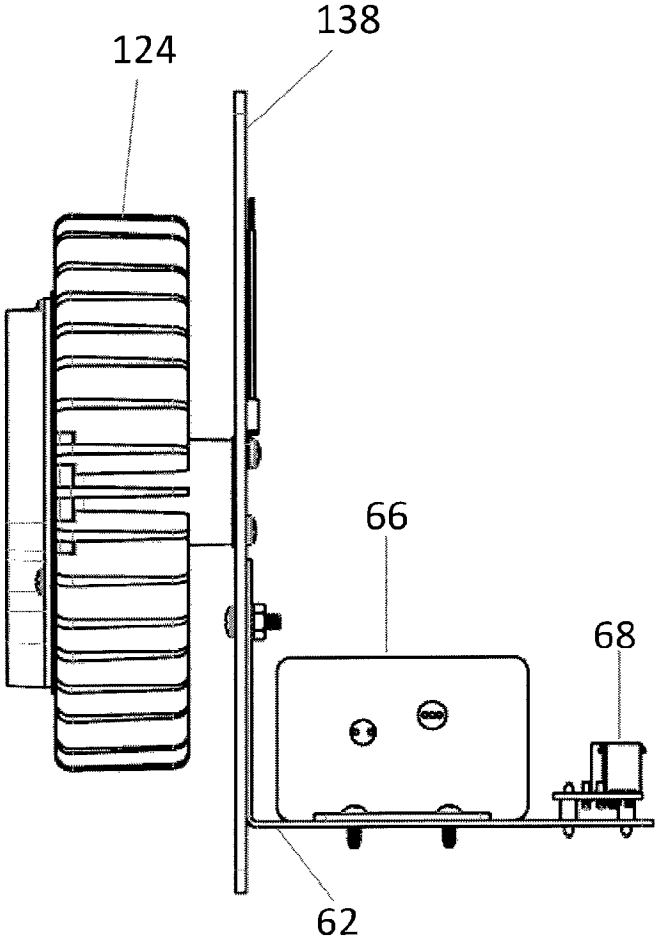
FIG. 12 is a side elevation view of the second preferred embodiment of invention.

Referring to FIGS. 10-13, the invented retrofit kit 10 may also take the form of a second generation of modules, lenses, lens plate, heat sink and the like. As in FIG. 10, a backer 138 has the form of a thin, essentially square plate with rounded corners. A mounting bracket 62 attaches to the backer 138 by a group of screws such as screw 63. Referring to FIG. 11, the screws are matched with hex nuts 64, and tighten the mounting bracket 62 to the backside of the backer 138. Drilled openings and slots in the backer 138 and bracket 62, respectively, allow the screws to pass.

Continuing primarily with FIG. 11, a power supply 66 mounts to the flange portion of the bracket 62 that extends transversely to the backer 138. Additional screws such as screw 67 fasten one ore more flange extensions of the power supply 66 to the bracket flange portion 62. The power supply is appropriate sized and wired, for example being a sixty watt power supply, to transmit electricity at appropriate power and voltage to the unit.

A control board 68 is also mounted to the bracket flange portion 62, across the power supply 66 from the backer 138. Several standoffs such as standoff 69 provide short distance between the board 68 and the bracket flange portion 62, while also accomplishing the mounting of the board to the portion 62. Appropriate electrical and electronic components are on the board 68.

A ground wire 69 mounts by a screw 71 to the backer 138 near its center.

Returning to FIG. 10 and the opposite side of the backer 138 from FIG. 11, as well as referring to FIG. 11, screws including the screw 71 extend through the backer 138. A heat sink 124 has a heat sink post 125, marked in FIG. 11. The post 125 extends transversely to the extent of the backer 138, defining a longitudinal axis 72, also marked in FIG. 11, with two directions of longitudinal extent. The backer 138 extends transversely of the axis 72. The screws such as screw 71 engage the post 125 to fasten the heat sink 124 adjacent the backer 138. Referring to FIG. 10, a heat sink post gasket 140 interposes the heat sink post 125 and the backer 138. The gasket 140 is also fastened in place by the screws such as screw 71.

Referring to FIGS. 10, 11 and now 12 and 13, the heat sink 124 further includes a radial disk portion 74 that extends radially and circumferentially outwardly from the heat sink post 125. Radial directions are directions of radii transverse to axis 72, outward from the axis 72, which is coincident with the central axis of the post 125. As shown, the disk portion 74 is substantially thinner axially than it is large radially. The outer rim of the disk portion is substantially circular. A tri-lobed outline 75 is present on the face of the disk portion 74, opposite the extent of the post 125. The outline 75 is "tri-lobed" in that it forms three lobes, such as lobe 77, each lobe extending along the outer rim of the disk portion 74 through somewhat less than a third of the extent of the circumference of the disk portion 74. Inwardly arced recesses such as recess 76 interpose adjacent lobes. At its center, and consistent with the center of the post 125 and backer 138, the disk portion 74 includes a generally rectangular opening 78, as in FIG. 10.

Figure 13:
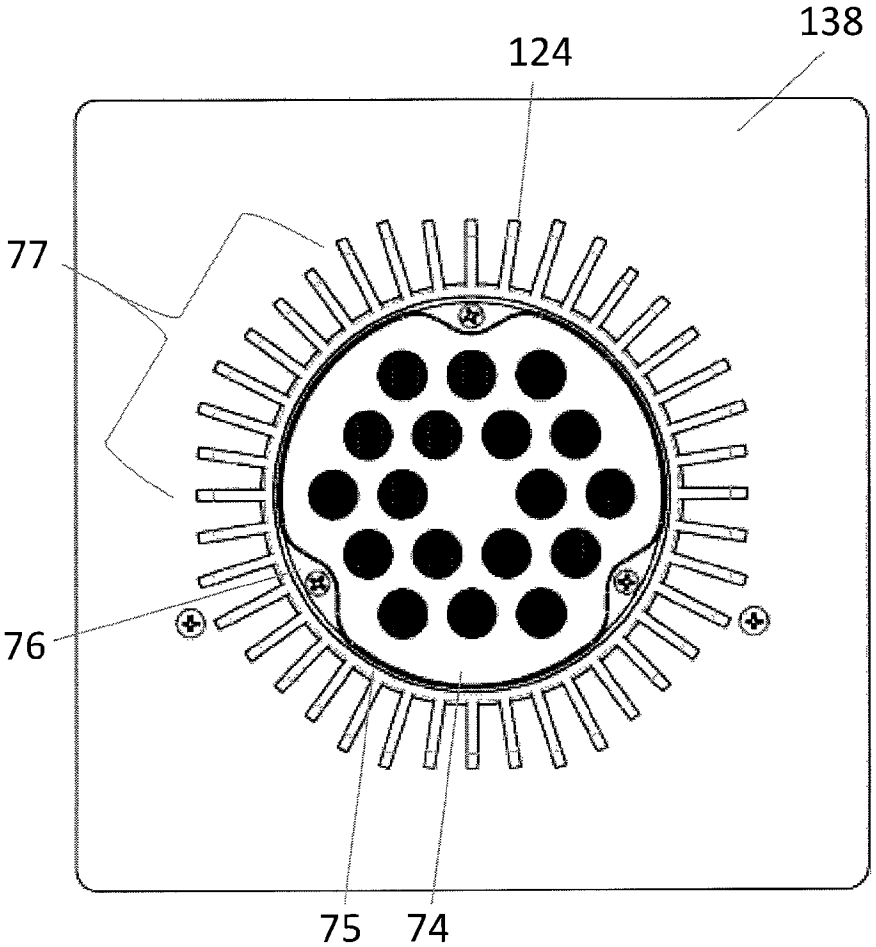
FIG. 13 is an end elevation view of the second preferred embodiment of invention, as seen from the left of FIG. 12.

Many radially outwardly extending heat sink fins such as fin 79, marked in FIG. 10, encircle the heat sink disk portion 74. As seen best in FIG. 12, each fin such as 79 has an axial extent greater than disk portion 74, and terminate at one axial end along the face of the disk portion 74, and at the opposite axial end, short of the axial extent of the post portion 125. As seen best in FIG. 13, the fins are variable in radial length. As seen in FIG. 13, proceeding clockwise and counterclockwise from twelve o'clock, the fins increase in radial length in about twenty-two and a half degrees in either direction, to a total of about forty-five degrees. The fins of peak radial length in this segment of fins are at the ends of this segment. Approximately five fins are in this segment. A line drawn along the radially outermost tips of the fins in this segment is essentially straight and horizontal. The segment just described repeats around the rest of the heat sink 124. The fins thus form eight such segments, and a continuous line along their radially outermost tips forms an octagon, an eight side figure of eight equal length straight lines. There are forty total fins. The fins are radially spaced from the post 125, as seen best in FIG. 11. As also seen there, each fin is also rectangular, and thin relative to their radial and axial extents.

Referring primarily to FIG. 10, a thermal pad 139, an LED plate 144 and a lens plate 132 complete the embodiment. As with the thermal pad 39, the LED third support 44, and the lens plate 32, each of the thermal pad 139, an LED third plate 144 and a lens plate 132 are plate-like in being thin in axial extent compared to radial extents, and they are stacked with the lens plate 132 most outward of the backer 138, the LED plate 144 next most outermost, and the thermal pad next, and innermost. The thermal pad 139, LED plate 144 and a portion of the lens plate 132 are all tri-lobed like the heat sink disk portion 74. Additional screws 83 and 85 hold the plate 132, plate 144 and pad 139 to the heat sink 124. Wiring as needed extends through the opening 78 and similar central openings in the plate 144 and pad 139.

As seen best in FIG. 13 again, the LEDs of the unit form a shape that is outwardly and inwardly hexagonal. That is, an outer group of twelve LEDs form a hexagon and an inward group of six LEDs also form a hexagon. Adjacent LEDs also form triangles.

With the second embodiment, five different lenses are available. They include units of 140, 120, 80, 40 degrees and a type 3, or 60 by 120. The degrees identify the light cone of the first four units. A unit of 140 degrees is very wide, as in a flood light. As degrees reduce, width reduces, to a unit of 40 degrees in the nature of a spot light. The type of 3 is a street light with the light put to ground in an oval pattern, hence the 60 by 120.

Also with the second embodiment, as compared to the first embodiment, the light output is three times greater. The second embodiment also uses three times the energy with the same LEDs. The heat sink size is substantially increased, to dissipate the sixty watts of energy producing the higher light output.

Additional embodiments of invention include a method of retrofitting a high intensity discharge lighting fixture, the fixture before being retrofit including a housing, a high intensity discharge light source and a high intensity discharge lens, and a high intensity discharge lighting fixture chamber defined between the housing and the high intensity discharge lens. The method comprises, in any order and not necessarily the stated order, a disabling step, a removing step, a placing step, an affixing step, a wiring step, and a mounting step.

Disabling involves disabling if not removing from the fixture the high intensity discharge light source. Removing involves at least partially removing at least a part of the high intensity discharge lens from the fixture, if not fully removing the lens from the fixture. Placing involves placing a first support for at least one hereinafter-identified light emitting diode light source in place of the at least a portion of the high intensity discharge lens, thereby providing a light emitting diode lighting fixture chamber between the first support, any remaining portion of the high intensity discharge lens, and the housing. Affixing involves affixing a second support for at least one light emitting diode light sources to the first support and positioning at least a part of the second support outside the light emitting diode lighting fixture chamber. Mounting involves mounting the above-referenced at least one light emitting diode light source to the second support outside the light emitting diode lighting fixture chamber. Wiring involves wiring the at least one light emitting diode light source to power. Placing also involves placing at least one light emitting diode light source lens to provide a lens for the at least one light emitting diode light source, also outside the light emitting diode lighting fixture chamber.

With the method accomplished, the retrofit high intensity discharge lighting fixture is no longer a source of high intensity discharge light and is instead a source of light emitting diode light, and also the at least one light emitting diode light source, being outside the light emitting diode lighting fixture chamber, is substantially free of exposure to the temperature effects of being within either the high intensity discharge lighting fixture chamber of the light emitting diode lighting fixture chamber.

Most preferably, the method comprises, in order, removing from the fixture the high intensity discharge light source, fully removing from the fixture the high intensity discharge lens, placing the first support in the place of the high intensity discharge lens, mounting a third support outside the light emitting diode lighting fixture chamber to the second support, mounting a plurality of light emitting diode light sources to the third support, and sealing a plurality of light emitting light source lenses to the third support, the plurality of light emitting diode light sources being sealed between the light emitting diode light source lenses and the third support, the number of light emitting light source lenses being such as to provide a lens for each of the plurality of light emitting diode light sources. The method also comprises locating at least one element of a light emitting diode light within the light emitting diode lighting fixture chamber, and wiring the light emitting diode light sources to the at least one element of a light emitting diode light that is located within the light emitting diode lighting fixture chamber.

The invention has been described in such full, clear, concise and exact terms as to enable a person of ordinary skill in the art to make and use the same. The preferred embodiment is described to describe the best mode of invention. To particularly point out and distinctly claim the subject matter regarded as invention, claims will conclude this application when filed as a non-provisional application.

What is claimed is:

1. A retrofit high intensity discharge lighting fixture, comprising:

a housing that before being retrofit included a high intensity discharge light source, a high intensity discharge lens, and a high intensity discharge lighting fixture chamber defined between the housing and the high intensity discharge lens, the housing excluding a routinely functioning high intensity discharge light source and excluding the high intensity discharge lens, the housing including at least a first support for a hereinafter-stated plurality of light emitting diode light sources, the first support being in place of the high intensity discharge lens, the housing thereby having a light emitting diode lighting fixture chamber between the first support and the housing;

at least one element of a light emitting diode light being located within the light emitting diode lighting fixture chamber;

a seal of the light emitting diode lighting fixture chamber between the first support and the housing;

a second support for the hereinafter-stated light emitting diode light sources affixed at least to the first support and being positioned at least in part outside the light emitting diode lighting fixture chamber, the second support including a wiring channel and hereinafter-identified wiring passing through the wiring channel, an further including a heat sink;

a third support outside the light emitting diode lighting fixture chamber, the third support mounted to the second support and the hereinafter-stated light emitting diode light sources being mounted to the third support;

the above-referenced plurality of light emitting diode light sources, mounted as above-described so as to be outside the light emitting diode lighting fixture chamber;

a plurality of light emitting light source lenses mounted and sealed to the third support, the light emitting diode light sources being sealed between the light emitting diode light source lenses and the third support, the number of light emitting light source lenses being such as to provide a lens for each of the plurality of light emitting diode light sources; and wiring connecting the light emitting diode light sources to power and connecting the light emitting diode light sources to the at least one element of a light emitting diode light that is located within the light emitting diode lighting fixture chamber;

whereby the retrofit high intensity discharge lighting fixture is no longer a source of high intensity discharge light and is instead a source of light emitting diode light, and also whereby the light emitting diode light sources, being outside the light emitting diode lighting fixture chamber, are substantially free of exposure to the temperature effects of being within either the high intensity discharge lighting fixture chamber of the light emitting diode lighting fixture chamber.

2. A retrofit high intensity discharge lighting fixture as in claim 1, the third support being in the form of a plate; the second support including an elongated post from the first support to the third support, the elongated post including the wiring channel.

3. A retrofit high intensity discharge lighting fixture as in claim 1 further comprising light-emitting-diode-light-source temperature monitors, and light-emitting-diode-light-source controls, the controls responding to the monitors to control at least one of the intensity of the light of the light emitting diode light sources, the temperature of the light emitting diode light sources and the power to the light emitting diode light sources.

4. A method of retrofitting a high intensity discharge lighting fixture, the fixture before being retrofit including a housing, a high intensity discharge light source and a high intensity discharge lens, and a high intensity discharge lighting fixture chamber defined between the housing and the high intensity discharge lens, comprising, in any order and not necessarily the stated order:

at least disabling if not removing from the fixture the high intensity discharge light source;

at least partially removing at least a part of the high intensity discharge lens from the fixture, if not fully removing the lens from the fixture;

placing a first support for at least one hereinafter-identified light emitting diode light source in place of the at least a portion of the high intensity discharge lens, thereby providing a light emitting diode lighting fixture chamber between the first support, any remaining portion of the high intensity discharge lens, and the housing;

affixing a second support for at least one light emitting diode light sources to the first support and positioning at least a part of the second support outside the light emitting diode lighting fixture chamber;

mounting the above-referenced at least one light emitting diode light source to the second support outside the light emitting diode lighting fixture chamber;

wiring the at least one light emitting diode light source to power; and placing at least one light emitting diode light source lens to provide a lens for the at least one light emitting diode light source, also outside the light emitting diode lighting fixture chamber;

whereby the retrofit high intensity discharge lighting fixture is no longer a source of high intensity discharge light and is instead a source of light emitting diode light, and also whereby the at least one light emitting diode light source, being outside the light emitting diode lighting fixture chamber, is substantially free of exposure to the temperature effects of being within either the high intensity discharge lighting fixture chamber of the light emitting diode lighting fixture chamber.

5. A method of retrofitting a high intensity discharge lighting fixture as in claim 4, the method comprising:

removing from the fixture the high intensity discharge light source;

fully removing from the fixture the high intensity discharge lens;

placing the first support in the place of the high intensity discharge lens;

mounting a third support outside the light emitting diode lighting fixture chamber to the second support;

mounting a plurality of light emitting diode light sources to the third support; and sealing a plurality of light emitting light source lenses to the third support, the plurality of light emitting diode light sources being sealed between the light emitting diode light source lenses and the third support, the number of light emitting light source lenses being such as to provide a lens for each of the plurality of light emitting diode light sources.

6. A method of retrofitting a high intensity discharge lighting fixture as in claim 5, the method comprising locating at least one element of a light emitting diode light within the light emitting diode lighting fixture chamber; and wiring the light emitting diode light sources to the at least one element of a light emitting diode light that is located within the light emitting diode lighting fixture chamber.

* * * * *